US006789478B1

(12) United States Patent
Kasper et al.

(10) Patent No.: US 6,789,478 B1
(45) Date of Patent: Sep. 14, 2004

(54) DEVICE AND METHOD FOR CONTROLLING FLUID DELIVERY

(75) Inventors: Kent Dirksen Kasper, Dover, NH (US); Lothar John Schroeder, Portsmouth, NH (US); Stephen Arthur Austin, Strafford, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/377,454

(22) Filed: Feb. 28, 2003

(51) Int. Cl.[7] ..... B41F 31/00

(52) U.S. Cl. ..... 101/352.13; 101/351.5; 101/147; 101/485; 101/493; 101/DIG. 32

(58) Field of Search ..... 101/352.13, 352.1, 101/351.5, DIG. 32, 349.1, 350.1, 130, 141, 147, 148, 483, 485, 493, 177, 484, 142

(56) References Cited

U.S. PATENT DOCUMENTS

| | | | | |
|---|---|---|---|---|
| 2,404,159 A | | 7/1946 | Barber | 91/67.8 |
| 3,613,578 A | * | 10/1971 | Heurich | 101/348 |
| 4,402,263 A | | 9/1983 | Honkawa | 101/350 |
| 4,604,951 A | * | 8/1986 | Ichikawa et al. | 101/352.13 |
| 4,896,601 A | | 1/1990 | Jeschke | 101/350 |
| 5,123,351 A | | 6/1992 | Guaraldi et al. | 101/350 |
| 5,327,829 A | * | 7/1994 | Miyoshi et al. | 101/177 |
| 5,383,394 A | | 1/1995 | Izume | 101/350 |
| 5,842,416 A | | 12/1998 | Olawsky et al. | 101/350.1 |
| 6,386,100 B1 | * | 5/2002 | Gaffney et al. | 101/142 |
| 6,481,352 B2 | * | 11/2002 | Mayer et al. | 101/484 |
| 6,615,726 B2 | * | 9/2003 | Douillard et al. | 101/483 |
| 2002/0177053 A1 | | 11/2002 | Calderon | 430/18 |

FOREIGN PATENT DOCUMENTS

| | | |
|---|---|---|
| DE | 3306257 | * 10/1983 |
| JP | 2000246873 | 12/2000 |

* cited by examiner

*Primary Examiner*—Eugene H. Eickholt
(74) *Attorney, Agent, or Firm*—Davidson, Davidson & Kappel, LLC

(57) ABSTRACT

A device for controlling delivery of an amount of fluid has a first rotating device having at least one peripheral first fluid transfer section, a second rotating device having at least one peripheral second fluid transfer section, and a device for setting a phase between the first and second fluid transfer sections. The device may be used for providing ink or dampening solution in a printing press.

32 Claims, 8 Drawing Sheets

DEVICE AND METHOD FOR CONTROLLING FLUID DELIVERY

BACKGROUND INFORMATION

The present invention relates to a device for controlling fluid delivery, for example for use in controlling ink or dampening solution delivery in a printing press.

U.S. Pat. No. 2,404,159 discloses a segmented ink transfer roller. The segments have spiral or straight ribs for transferring a given amount of ink. A change in the amount of ink transfer is achieved by exchanging the sleeve-type segments.

U.S. Pat. No. 4,896,601 discloses an ink transfer roller with recessed areas and one or more raised areas for transferring ink. The transfer rollers are driven by friction when the raised areas contact the ink fountain roller or a first distribution roller. The ink transfer roller surface speed must alternate to match whichever roll it periodically contacts.

U.S. Pat. No. 5,383,394 discloses an axially divided vibrating roller. Each segment of the vibrating roller is individually shiftable by a magnetic device.

U.S. Pat. No. 5,123,351 discloses a speed matched ductor assembly for transferring ink with first and second idler rollers movable between an ink pick up and an ink transfer position.

U.S. Pat. No. 4,402,263 discloses a segmented ink transfer control roller having individually radially adjustable ink transfer portions.

Japanese Pat. Document 2000-246873 discloses an image writing unit for writing with repellant or lipophilic ink. The image writing unit is arranged near an ink fountain roller along a shaft of the roller. In the unit, a lipophilic part and an ink repellant part are formed corresponding to a printing element rate of a press plate supplied for printing on the roller. All circumferential and axial areas of the roller are divided in a horizontal and vertical network state. An areal rate of the lipophilic part at each measure is set to increase or decrease an ink supply amount corresponding to the element rate of the press plate in an axial direction of the roller.

BRIEF SUMMARY OF THE INVENTION

An object of the present invention is to provide for precise metering of fluid.

An additional or alternate object of the present invention is to provide a robust, repeatable fluid delivery device and/or method.

The present invention provides a device for controlling delivery of an amount of fluid comprising: a first rotating device having at least one peripheral first fluid transfer section; a second rotating device having at least one peripheral second fluid transfer section; and a device for setting a phase between the first and second fluid transfer sections.

By being able to set the phase between the first and second fluid transfer sections, the fluid can be precisely, robustly and repeatably provided, as the fluid transfer overlap between the first and second devices can be precisely controlled.

Preferably, the first rotating device includes a first fluid non-transfer section located in a peripheral direction from the first fluid transfer section and the second rotating device includes a second fluid non-transfer section located in a peripheral direction from the second fluid transfer section.

Thus, if fluid from the first fluid transfer section coincides with the second fluid non-transfer section, this fluid is not transferred by the second rotating device.

The at least one first fluid transfer section may include two or more first fluid transfer sections spaced equidistantly in a peripheral direction, and the first rotating device may include two or more first fluid non-transfer sections between the first fluid transfer sections. The at least one second fluid transfer section may include two or more second fluid transfer sections spaced equidistantly in a peripheral direction, and the second rotating device may include two or more second fluid non-transfer ring sections between the second fluid transfer sections. The increased number of sections advantageously can reduce the phase angle change required between the first and second rotating devices to alter a specific fluid delivery.

The first fluid transfer section and the first fluid non-transfer section preferably have a same peripheral extent as do the second fluid transfer section and the second fluid non-transfer section.

Preferably, the first and/or second fluid transfer section protrudes, and the first and/or second fluid non-transfer section is recessed. The recessing advantageously provides an effective and simple means for creating the non-transfer function property of the first and/or second fluid non-transfer sections. The recess of the first and/or second fluid non-transfer section maybe deeper than a thickness of a fluid film on the first and/or second fluid transfer section, and preferably is many times that thickness.

The first and/or second fluid transfer section may define a curved rectangle or be spiral-shaped.

The first or second fluid transfer section preferably is made of an elastic deformable material, such as natural or artificial rubber, while the other fluid transfer section is made of a rigid material, such as metal, plastic or ceramic.

The first fluid transfer section may have an oleophilic surface for attracting ink and the first non-fluid transfer section may have a fluid repellant surface repelling the fluid, the fluid repellant surface being oleophopic and/or hydrophilic.

The first rotating device and second rotating device may define a gap therebetween, the gap being a timed or repeating gap, for example repeating with each rotation of the rotating devices. The gap may be formed between the first fluid transfer section and the second fluid non-transfer section, for example.

The first and second rotating devices preferably have the same peripheral speed, which may be directly related to a machine speed. A gear drive may drive the first and second rotating devices in a same or opposite rotational direction.

The first and/or second rotating device may include segments spaced axially, and the segments may be individually adjustable by the phase-setting device to control delivery of fluid over a respect axial extent of the segment.

The first and/or second rotating device preferably is a cylinder, and thus a first cylinder and a second cylinder may be provided, the first cylinder having a first diameter and the second cylinder having a second diameter. The first and second diameters have a ratio relative to each other which is an integer, for example 1 or 2.

The first and/ or second cylinder may include a shaft with the fluid transfer section having an internal control mechanism of the phase setting device for controlling a peripheral location of the first fluid transfer section. The internal control mechanism is located on the shaft, and may be axially segmented.

The internal control mechanism may include a stepper motor, a worm gear, a transfer gear and a ring gear, the ring gear being peripherally adjustable with respect to the shaft.

Instead of the cylinders, the first and/or second rotating device may include a rotating belt, for example having raised and recessed sections.

A third or more rotating devices may be located between the first and second rotating devices, so long as they have a similar diameter or peripheral extent as the first and second rotating devices or an integer thereof.

The fluid may be for example a printing ink, a dampening solution or a gloss coating.

Thus the present invention also provides an inking device for controlling delivery of an amount of ink comprising a first rotating device having at least one first peripheral ink transfer section, a second rotating device having at least one second peripheral ink transfer section, and a device for setting a phase between the first and second ink transfer sections.

Also provided is a dampening device for controlling delivery of an amount of dampening solution comprising a first rotating device having at least one first peripheral dampening solution transfer section, a second rotating device having at least one second peripheral dampening solution transfer section, and a device for setting a phase between the first and second dampening solution sections.

The present invention also provides a method for controlling delivery of an amount of fluid comprising the steps of: providing a fluid to a first rotating device having at least one peripheral first fluid transfer section; transferring at least a portion of the fluid to a second rotating device having at least one peripheral second fluid transfer section; and controlling the portion through setting of the phase between the first and second fluid transfer sections. An overlap length of the first and second fluid transfer sections may be set.

BRIEF DESCRIPTION OF THE DRAWINGS

The present invention is described with respect to the fluid delivery device being configured as an ink supply device or dampening solution device, in which.

DETAILED DESCRIPTION

Figure 1:
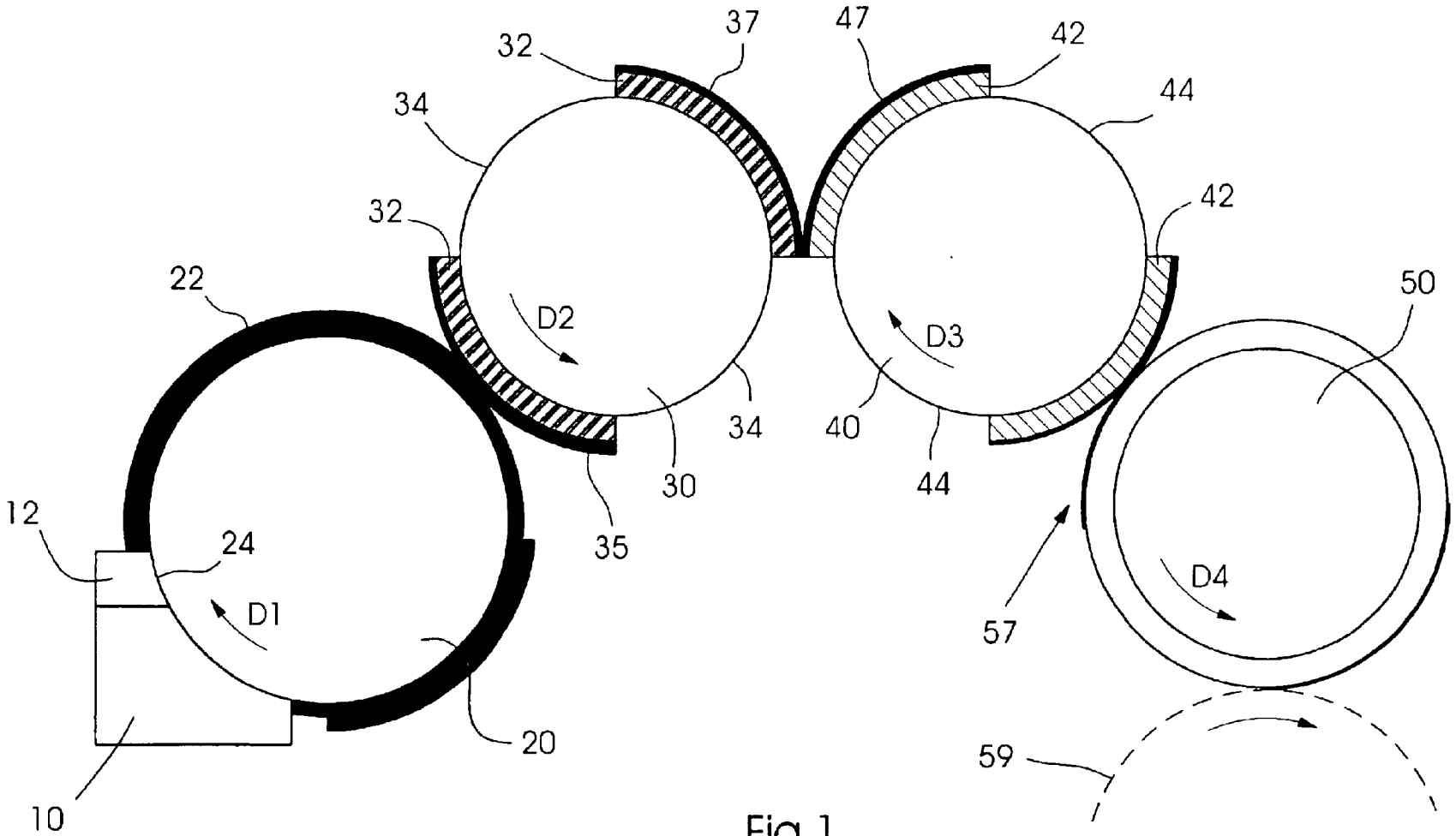
FIG. 1 shows a first embodiment of an inker according to the present invention with the rotating devices at zero phase with respect to one another.

FIG. 1 shows a preferred embodiment of an ink supply device of the present invention in which cylinders are used as the rotating devices. A supply roller 20, rotating in direction D1, receives ink from an ink supply 10. Ink supply 10 may have a premetering device 12, such as a scraper blade. As a result, a uniform premetered ink film 22 is applied to an outer peripheral surface 24 of supply roller 20. While a fountain with a continuous blade 12 is shown, the ink supply 10 also could be an anilox roller or inker, a roll with a spraying device, an ink fountain system with zone blades, or an ink jet system, or other supply device for providing a premetered film 22.

The ink supply device further includes a first rotating device, in this preferred embodiment, an ink transfer cylinder 30 having peripheral ink transfer sections 32 and peripheral ink non-transferring sections 34 and rotating in direction D2. In this embodiment, the ink transfer sections 32 are radially-protruding deformable sections, having for example, made of a rubber coating on a metal cylinder body. Such a rubber outer surface permits good ink transfer. The non-transfer sections 34 may be simply composed of sections of the metal cylinder body not covered with the radially-protruding rubber coating, and thus are recessed radially with respect to the larger diameter surface defined by the ink transfer sections 32 of the cylinder 30. The non-transfer sections 34 may be made, for example, by cutting away a peripheral section of a fully rubber-coated metal cylinder. Due to the recessing, no ink is transferred from supply roller 20 to non-transfer sections 34, while an ink film 35 results on ink-transfer section 32

Interacting with ink transfer cylinder 30 is a second ink transfer cylinder having peripheral ink-transfer sections 42 and peripheral ink non-transfer sections 44. The ink transfer sections 42 preferably are made of a hard ink-transferring coating, for example metal, plastic or ceramic and are radially-protruding with respect to a cylinder body. The non-transfer sections 44 may simply be composed of sections of the cylinder body not covered with the radially-protruding hard coating, and thus are recessed radially with respect to the larger diameter surface defined by the transfer sections 42. The non-transfer sections 44 may be made, for example, by cutting away a peripheral section of a ceramic, metal or plastic-coated cylinder.

To transfer ink between cylinder 30 and cylinder 40, at least a portion of the ink transfer sections 32 and 42 interact, with ink being transferred from the softer surface of the sections 32 to the harder surface of the sections 42. The ink-transfer sections 32 of cylinder 30 and the ink-transfer sections 42 of cylinder 40 are phaseable with respect to one another, i.e. the peripheral amount of the sections 32, 42 which contact each other is adjustable. Preferably, the peripheral extent of all sections 32 is exactly half the peripheral extent of cylinder 30, and the peripheral extent of all sections 42 is exactly half of the peripheral extent of cylinder 40, and cylinders 30 and 40 have the same diameter. The range of contact thus can range from a zero phase difference between the two cylinders 30, 40 where the peripheral extents of the sections 32, 42 exactly match (full ink transfer) to another phase difference during which the outer surface of sections 32, 42 do not contact (no ink transfer), in this embodiment a 90 degree phase difference. Were each cylinder 30, 40 to have only a single ink transfer section covering half the circumference, a 180 degree phase shift would be required to obtain the full range of contact.

FIG. 1 thus shows the zero degree phase difference situation, with cylinder 40 moving in direction D3, and sections 42 interacting along their entire peripheral extent with the sections 32 of cylinder 30.

Ink is thus transferred from section 32 to section 42, which may then interact with an inker roll 50 moving in direction D4, having for example a rubber surface, to further transfer the ink. As shown, section 32 retains some ink 37 even after a full transfer to section 42, which obtains an ink film 47, which then provides an ink film 57 to roll 50. Inker roll 50 may then interact with the remainder of the inking device 59, which contacts an image carrier, for example a plate cylinder. U.S. Pat. No. 6,386,100, for example, discloses an offset lithographic printing press with a plate cylinder, and is hereby incorporated by reference herein.

Figure 2:
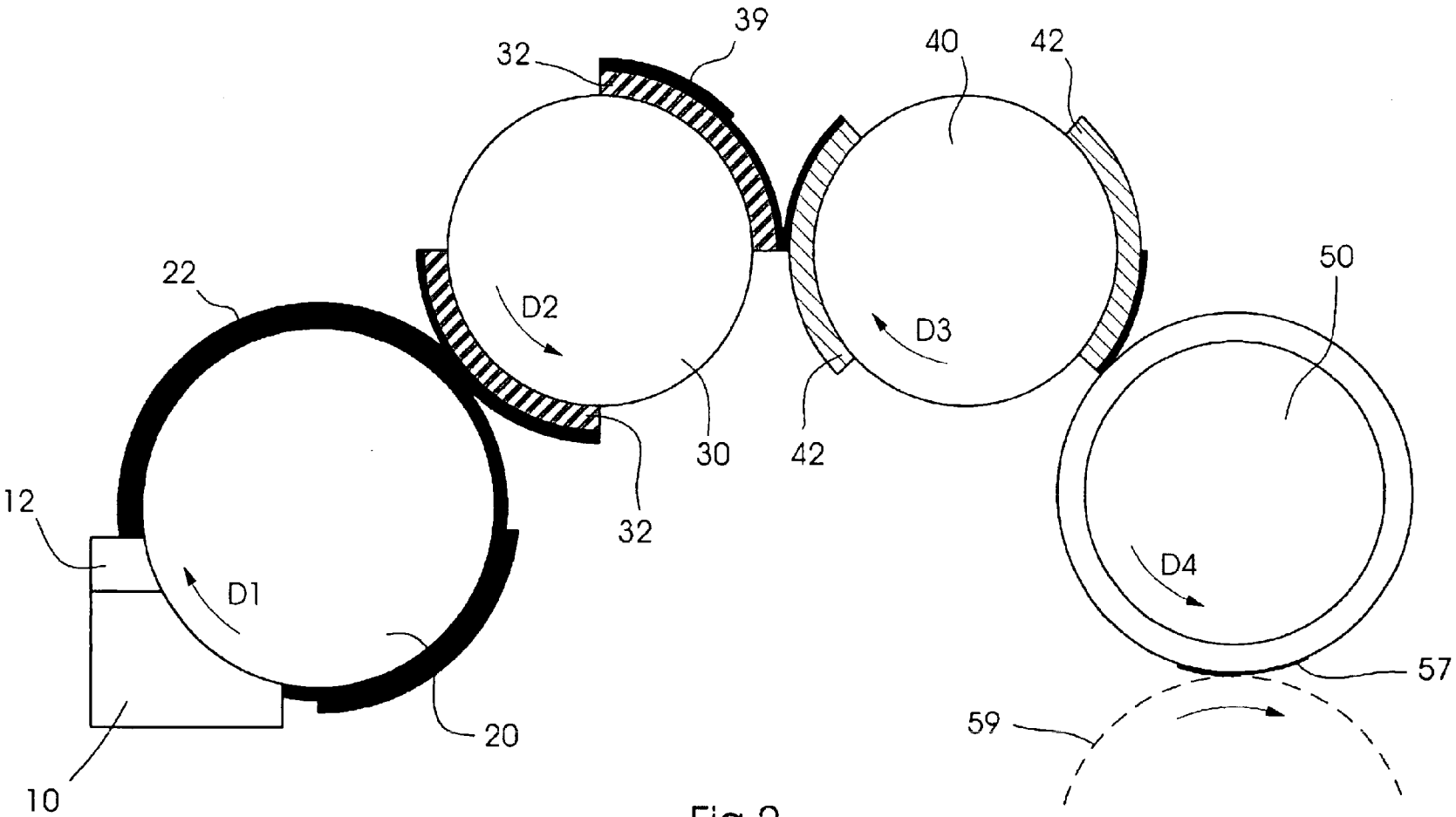
FIG. 2 shows the embodiment of FIG. 1 with the rotating devices phased 45 degrees with respect to one another.

FIG. 2 shows the same embodiment as in FIG. 1 with sections 42 of cylinder 40 phased 45 degrees with respect to sections 32 of cylinder 30. At this phase, only half the ink is transferred from sections 32 to sections 42 as in the zero degree phase. As shown, a thicker ink section 39 remains on section 32, since section 32 did not contact section 42 at his location. By altering the phase in a controlled manner, a very precise ink transfer can be achieved for between the sections 32 and 42, and thus the amount of ink to be transferred by the entire inking device to an image carrier.

FIGS. 1 and 2 show just one axial section of the cylinders 30, 40. In order to control the ink delivery precisely in various axial regions of the inking device, a plurality of side-by-side ink transferring sections 32 and ink transferring sections 42 may be provided for each cylinder 30, 40 respectively.

Figure 3:
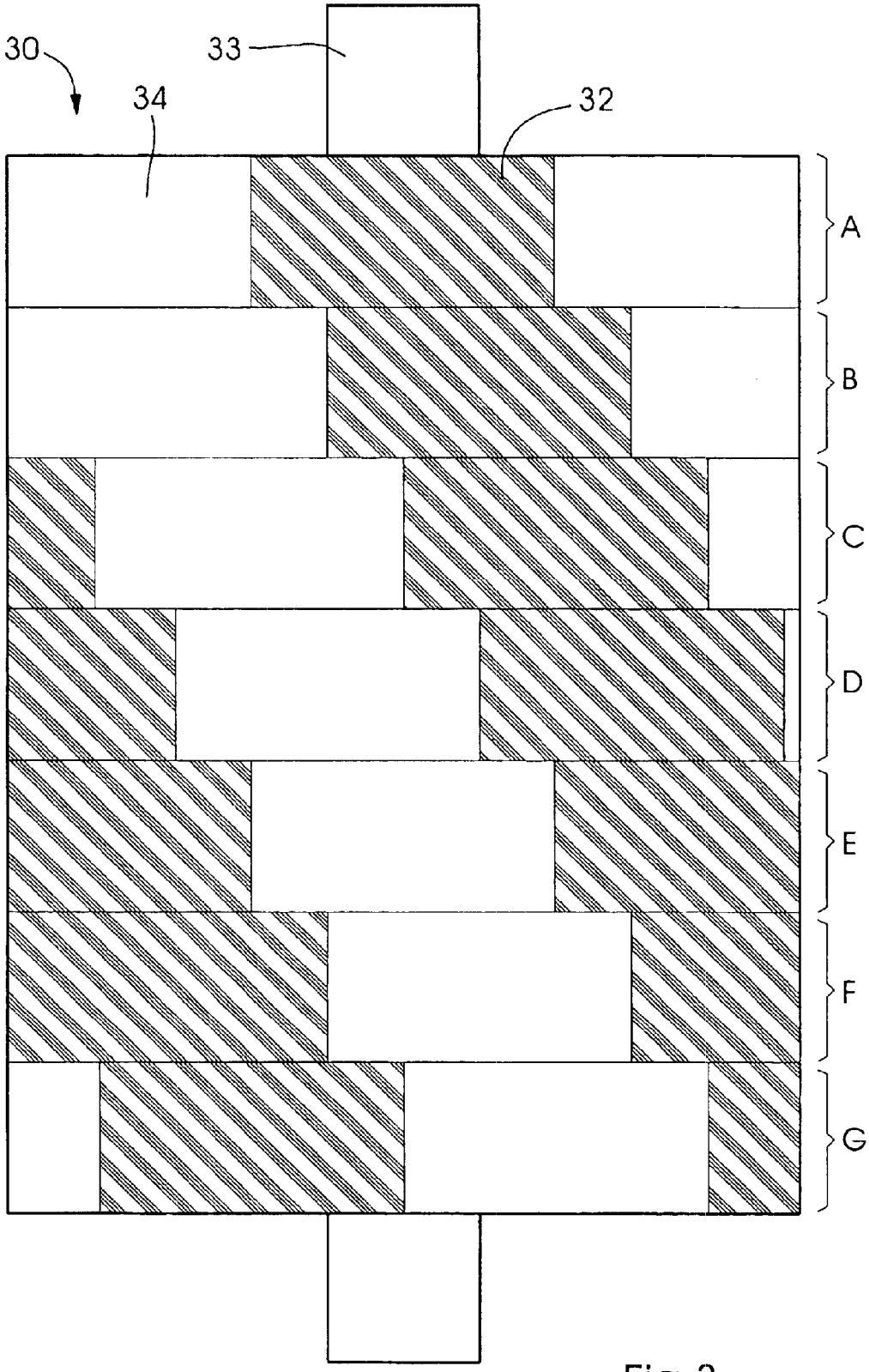
FIG. 3 shows a top plan view of a first of the rotating devices.

FIG. 3 shows for example cylinder 30 with ink-transfer sections 32 spaced along seven different axial regions A, B, C, D, E, F, G of the cylinder 30. While the sections 32 preferably are staggered peripherally to reduce vibrational shock when contacting cylinder 40, they also may have the same peripheral location. In the embodiment shown the sections 32 of cylinder 30 are fixed with respect to the cylinder body. Non-transfer sections 34 are located peripherally of sections 32. A shaft 33 can drive the cylinder 30.

Figure 4:
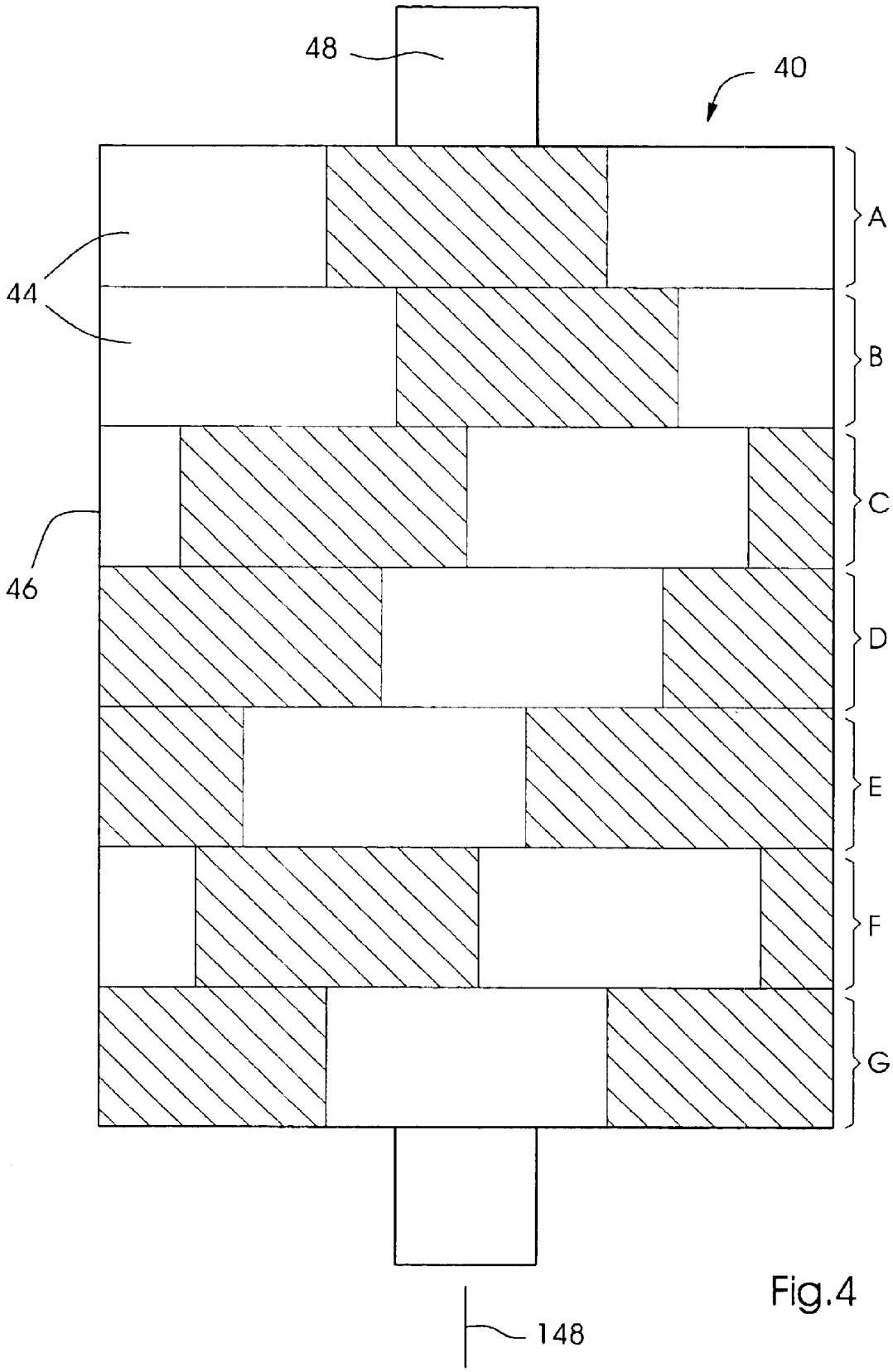
FIG. 4 shows a top plan view of a second of the rotating devices.

As shown in FIG. 4, cylinder 40 is composed of individually rotatable lateral segments 46, of which there are also seven, so that the peripheral location of each section 42 may be set depending on the rotational position of the segment 46 with respect to the cylinder body. Thus each segment 46 may be phased with respect to the cylinder 30. Shaft 48 may drive cylinder 40.

Viewing FIGS. 3 and 4 together, regions A and B would provide 100 percent ink supply, as sections 32 and 42 are fully in phase (zero degree phase difference). Region C provides no ink transfer, as sections 32 and 42 are fully out of phase (90 degrees apart in the embodiment shown with two ink transfer sections in the circumferential direction). Region D and G provide half ink transfer, E and F three-quarters ink transfer. Each segment 46 is thus independently settable to provide a desired ink transfer amount.

Figure 5:
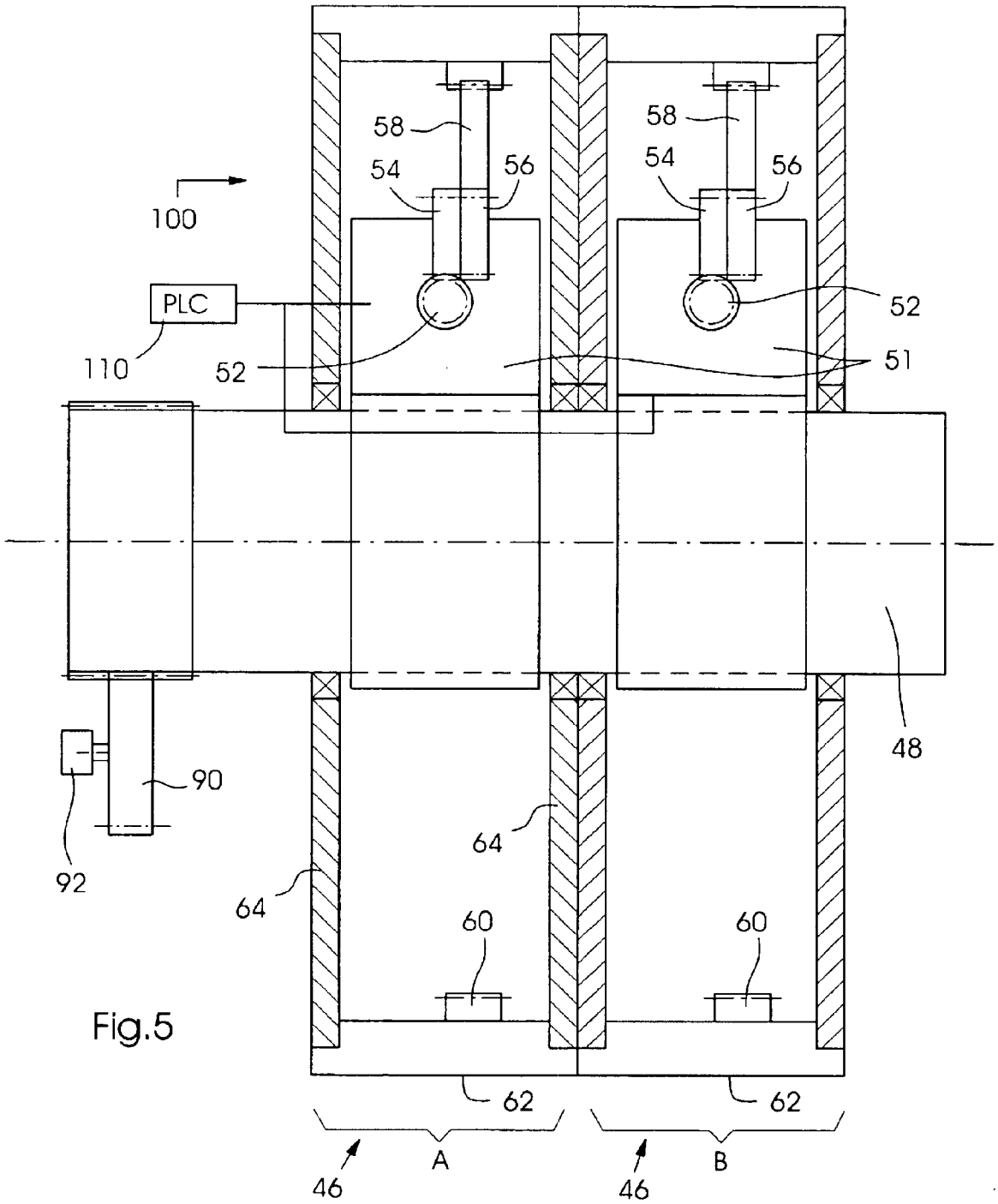
FIG. 5 shows a side cut-way view of the device of FIG. 4.

FIG. 5 shows a device 100 for phasing the individual segments 46 with respect to a cylinder shaft 48, which is driven by a machine gear wheel 90 connected to a machine drive 92, which also drives cylinder 30. Individual segments 46 each include end plates 64 rotatable with respect to shaft 48, for example bearingly supported thereon, and a circular surface plate 62 supported by the end plates 64. Ink transfer sections 42 (FIG. 1) are supported on the surface plates 62. A stepper motor 51 with or without an encoder can drive a worm gear 52 which rotates a wheel 54 and spur gears 56 and 58. A ring gear 60 fixedly attached to circular surface plate 62 interacts with spur gear 58. Thus rotation of the worm gear 52 by the stepper motor 51 can set the rotational angle of the sections 42 with respect to shaft 48. A controller 110 of device 100 may control the step motors 51.

Figure 6:
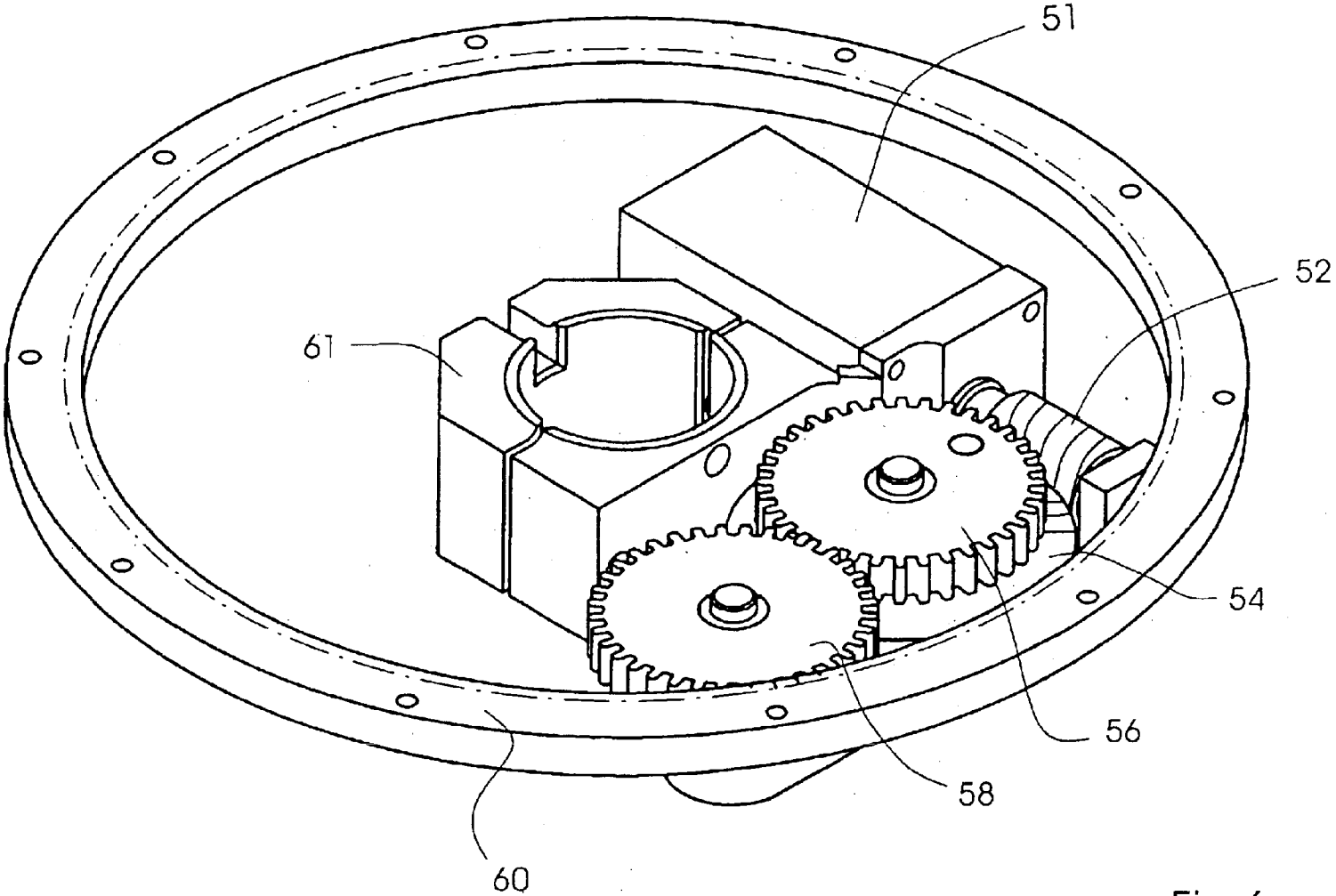
FIG. 6 shows a perspective view of the phase setting device of FIG. 5.

FIG. 6 shows a perspective view of a segment of device 100 for setting the phase, using the same numbering as in FIG. 5. Ring gear 60 attaches to the circular plate 62 (FIG. 5) and a shaft clamp 61 to shaft 48 (FIG. 5) for each segment.

The stepper motor thus can provide a very fine scale resolution of the phase, and thus the fluid delivery for each region A, B, C, D, E, F, and G. For example, with equal sized spur gears 56, 58, a stepper motor with 200 steps per revolution, a worm gear 52 to wheel 54 ratio of 25:1, and a spur gear 58 to ring gear ration of 10:1, each step provides about 0.0072 degrees of phase resolution. Depending on the number and width of sections 42, as well as the diameter of cylinder 40, fluid delivery control of better than 0.01 percent per step can be achieved.

Figure 7:
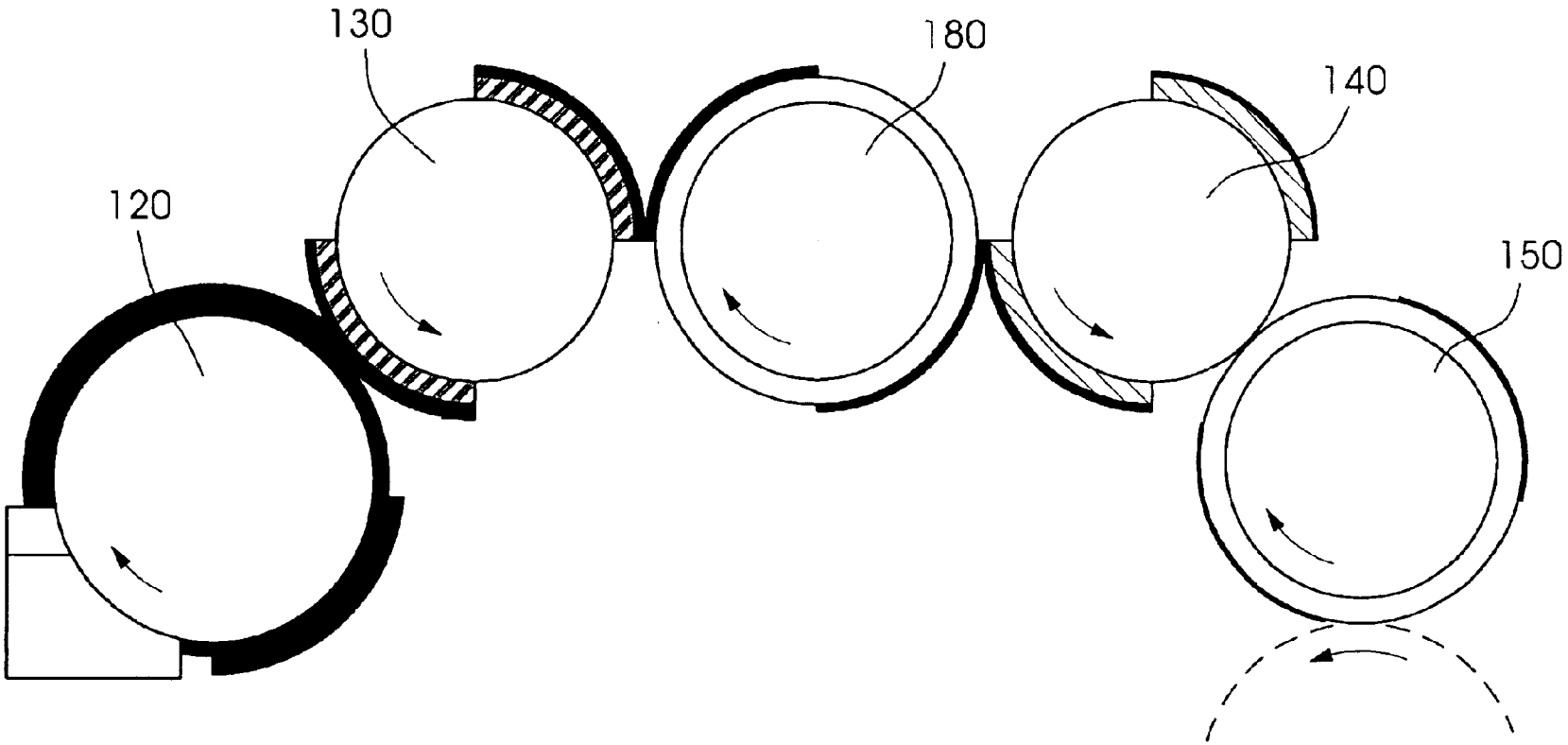
FIG. 7 shows an alternate embodiment of the inker of FIG. 1.

FIG. 7 shows an alternate embodiment with a third rotating device 180 located between a first rotating device 130 and a second rotating device 140. Devices 120, 130, 140 and 150 are similar to devices 20, 30, 40, 50, respectively, as shown in FIG. 1, with devices 140 and 150 rotating in opposite directions. Device 180 preferably is a cylinder having a same diameter or integer diameter of the outer diameter of devices 30 and 40. It should also be noted that in the FIG. 1 embodiment cylinder 40 could rotate in the opposite direction, although this is not preferable.

Figure 8:
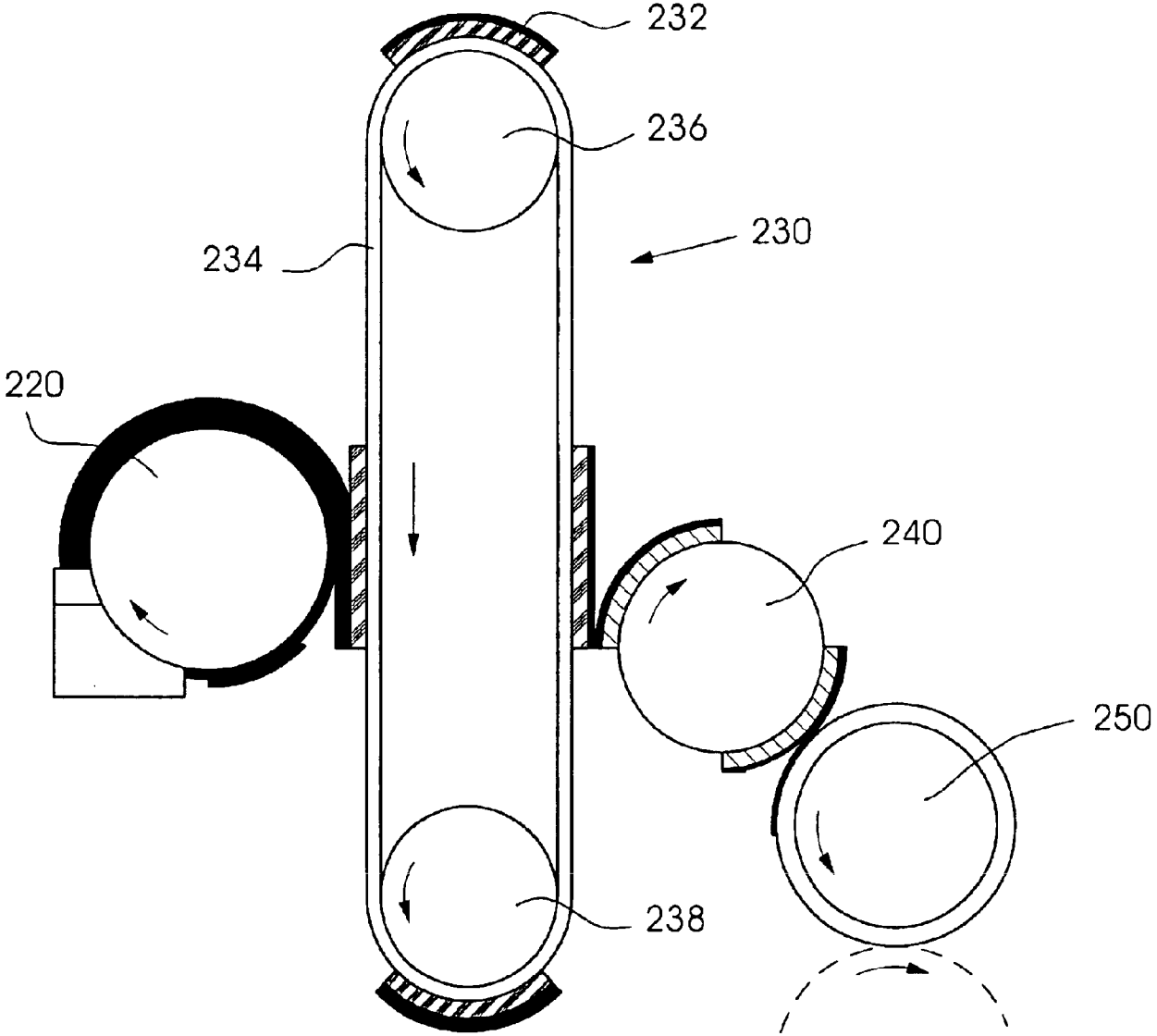
FIG. 8 shows an alternate embodiment of the inker of FIG. 1.

FIG. 8 shows another embodiment alternate to the FIG. 1 embodiment in which a belt device 230 interacts with an ink supply roller 220 and a second cylinder 240. Devices 220, 240 and 250 may be similar to cylinders 20, 40, 50 as shown in the FIG. 1 embodiment. The peripheral extent of belt 230 preferably is an integer of the circumferential extent of cylinder 240. Cylinder 240 also may be a belt.

Alternate to the raised sections 32, 42 shown, rotating devices 30, 40 may have alternating oleophilic and oleophobic outer surfaces having a same diameter.

What is claimed is:

1. A device for controlling delivery of an amount of fluid comprising:

a first rotating device having at least one peripheral first fluid transfer section;

a second rotating device having at least one peripheral second fluid transfer section; and a device for setting a phase between the first and second fluid transfer sections.

2. The device as recited in claim 1 wherein the first rotating device includes a first fluid non-transfer section located in a peripheral direction from the first fluid transfer section and the second rotating device includes a second fluid non-transfer section located in a peripheral direction from the second fluid transfer section.

3. The device as recited in claim 1 wherein the at least one first fluid transfer section includes two or more first fluid transfer sections spaced equidistantly in a peripheral direction, and the first rotating device includes two or more first fluid non-transfer sections between the first fluid transfer sections, and wherein the at least one second fluid transfer section includes two or more second fluid transfer sections spaced equidistantly in a peripheral direction, and the second rotating device includes two or more second fluid non-transferring sections between the second fluid transfer sections.

4. The device as recited in claim 2 wherein the first fluid transfer section and the first fluid non-transfer section have a same peripheral extent and the second fluid transfer section and the second fluid non-transfer section have a same peripheral extent.

5. The device as recited in claim 2 wherein the first fluid transfer section protrudes, and the first fluid non-transfer section is recessed.

6. The device as recited in claim 5 wherein a recess of the first fluid non-transfer section is deeper than a thickness of a fluid film on the first fluid transfer section.

7. The device as recited in claim 1 wherein the first fluid transfer section defines a curved rectangle or is spiral-shaped.

8. The device as recited in claim 1 wherein the first fluid transfer section is made of an elastic deformable material.

9. The device as recited in claim 8 wherein the material is natural or artificial rubber.

10. The device as recited in claim 1 wherein the first fluid transfer section is made of a rigid material.

11. The device as recited in claim 10 wherein the rigid material is selected from one of metal, plastic and ceramic.

12. The device as recited in claim 2 wherein the first fluid transfer section has an oleophilic surface and the first fluid non-transfer section has a fluid repellant surface repelling the fluid.

13. The device as recited in claim 12 wherein the fluid repellant surface is oleophopic or hydrophilic.

14. The device as recited in claim 1 wherein the first rotating device and second rotating device define a gap therebetween.

15. The device as recited in claim 14 wherein the first fluid transfer section forms a timed gap with the second fluid transfer section.

16. The device as recited in claim 1 wherein the first and second rotating devices have the same peripheral speed.

17. The device as recited in claim 16 wherein the first and second rotating devices rotate at a same machine speed.

18. The device as recited in claim 1 further comprising a gear drive driving the first and second rotating devices in a same or opposite rotational direction.

19. The device as recited in claim 1 wherein the first rotating device includes segments spaced axially.

20. The device as recited in claim 19 wherein the segments are individually adjustable to control delivery of fluid over a respect axial extent of the segment.

21. The device as recited in claim 1 wherein the first rotating device is a first cylinder.

22. The device as recited in claim 21 wherein the first cylinder has a first diameter and the second rotating device is a second cylinder having a second diameter, the first and second diameters having a ratio being an integer.

23. The device as recited in claim 21 wherein the first cylinder has a shaft, the first fluid transfer section having an internal control mechanism for controlling a peripheral location of the first fluid transfer section, the internal control mechanism being located on the shaft.

24. The device as recited in claim 23 wherein the internal control mechanism is axially segmented.

25. The device as recited in claim 23 wherein the internal control mechanism includes a stepper motor, a worm gear, a transfer gear and a ring gear, the ring gear being peripherally adjustable with respect to the shaft.

26. The device as recited in claim 1 wherein the first rotating device includes a belt.

27. The device as recited in claim 1 wherein the fluid is a printing ink or a dampening solution.

28. The device as recited in claim 1 further comprising a third rotating device between the first and second rotating devices.

29. An inking device for controlling delivery of an amount of ink comprising:

a first rotating device having at least one first peripheral ink transfer section;

a second rotating device having at least one second peripheral ink transfer section; and a device for setting a phase between the first and second ink transfer sections.

30. A dampening device for controlling delivery of an amount of dampening solution comprising:

a first rotating device having at least one first peripheral dampening solution transfer section;

a second rotating device having at least one second peripheral dampening solution transfer section; and a device for setting a phase between the first and second dampening solution sections.

31. A method for controlling delivery of an amount of fluid comprising the steps of:

providing a fluid to a first rotating device having at least one peripheral first fluid transfer section;

transferring at least a portion of the fluid to a second rotating device having at least one peripheral second fluid transfer section; and controlling the portion through setting of the phase between the first and second fluid transfer sections.

32. The method as recited in claim 31 wherein an overlap length of the first and second fluid transfer sections is set.

* * * * *